United States Patent [19]

Kaeding et al.

[11] 4,004,593

[45] Jan. 25, 1977

[54] METHOD AND APPARATUS FOR CLASSIFYING CIGARETTES OR THE LIKE

[75] Inventors: Heinz Kaeding, Geesthacht; Alexandros Nicolas, Wittenborg, both of Germany

[73] Assignee: Hauni-Werke Korber & Co., KG, Hamburg-Bergedorf, Germany

[22] Filed: Apr. 9, 1975

[21] Appl. No.: 566,336

Related U.S. Application Data

[60] Division of Ser. No. 293,372, Sept. 29, 1972, which is a continuation of Ser. No. 787,536, Dec. 27, 1968, abandoned.

[52] U.S. Cl. ..... 131/21 R; 131/65; 73/45.1

[51] Int. Cl.[2] ..... A24B 7/14; A24C 5/32

[58] Field of Search ..... 131/21 R, 21 B, 94, 131/65, 108, 63; 209/73, 74, 111.1; 73/45.1

[56] References Cited

UNITED STATES PATENTS

| | | | |
|---|---|---|---|
| 2,945,587 | 7/1960 | Bell et al. | 131/21 R X |
| 3,034,645 | 5/1962 | Groppe | 131/21 R X |
| 3,237,444 | 3/1966 | Kaeding et al. | 131/21 R |
| 3,368,671 | 2/1968 | Kaeding | 209/73 |
| 3,412,856 | 11/1968 | Esenwein | 131/21 R X |
| 3,491,767 | 1/1970 | Kaeding | 131/21 R |

*Primary Examiner*—Stephen C. Pellegrino
*Attorney, Agent, or Firm*—Peter K. Kontler; John Kurucz

[57] ABSTRACT

Plain cigarettes which are produced in a multi-speed cigarette rod machine are transported toward a filter cigarette machine. Some or all of the cigarettes which are produced while the cigarette rod machine operates at less than normal speed are ejected before they reach the filter cigarette machine. The filter cigarette machine is started with a delay following starting of the cigarette rod machine and the ejecting device between the two machines removes all such cigarettes which are defective for one or more additional reasons, such as the presence of a splice in the wrapper of a cigarette, a defective seam on the wrapper and/or when the filler of the cigarette contains too little or too much tobacco.

11 Claims, 8 Drawing Figures

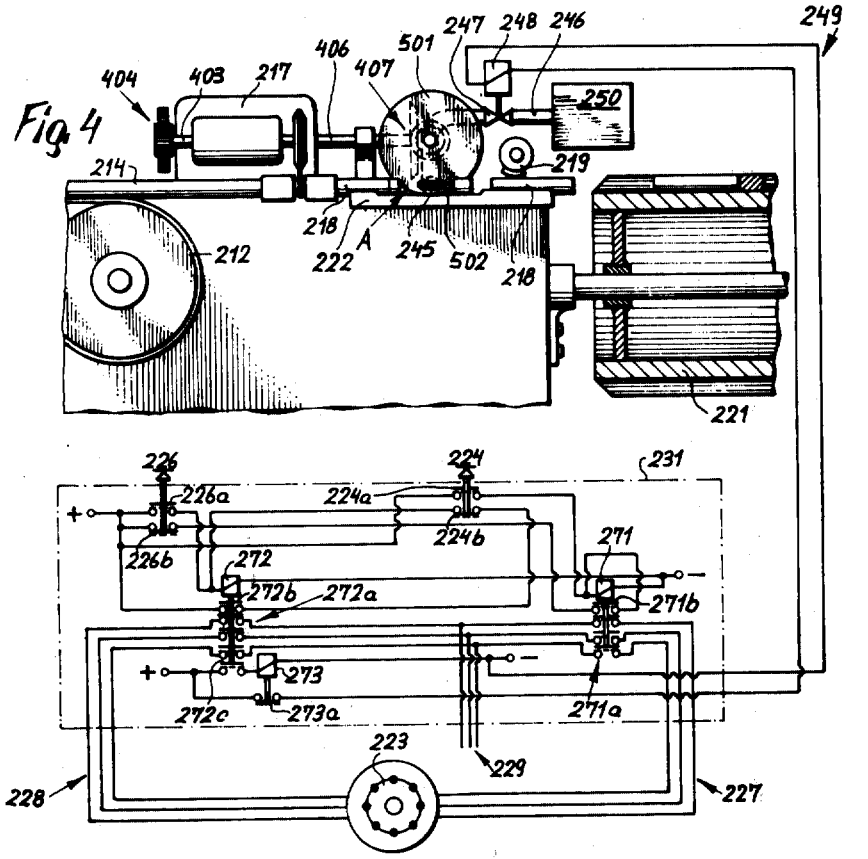
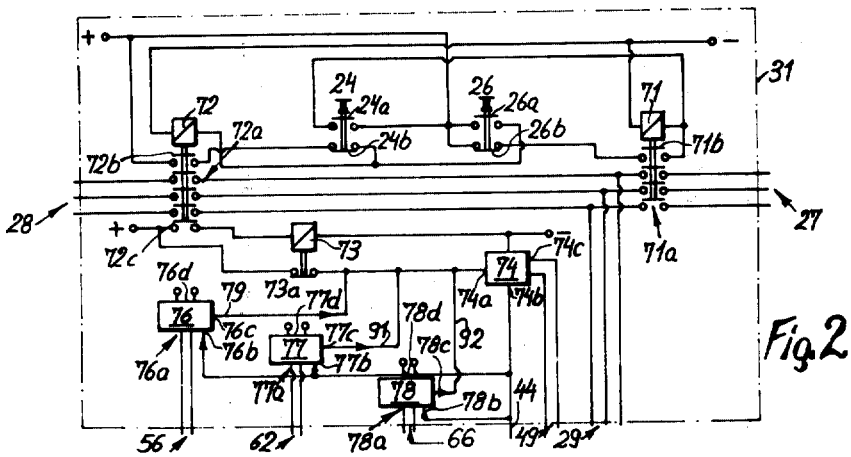
Fig. 2

METHOD AND APPARATUS FOR CLASSIFYING CIGARETTES OR THE LIKE

CROSS-REFERENCE TO RELATED APPLICATION

This is a division of the copending application Ser. No. 293,372 filed Sept. 29, 1972. The application Ser. No. 293,372 is a continuation of Ser. No. 787,536 filed Dec. 27, 1968, now abandoned.

BACKGROUND OF THE INVENTION

The present invention relates to a method and apparatus for classifying plain cigarettes or filter cigarettes of unit length or multiple unit length, cigars, cigarillos or cheroots with or without filters, filter tips or filter rod sections of unit length or multiple unit length, and analogous rod-shaped articles. More particularly, the invention relates to a method and apparatus for segregating defective and potentially defective rod-shaped articles from satisfactory articles while such articles are transported from a producing or making machine at a first station to a second station where the articles are subjected to one or more further treatments. The method and apparatus of the present invention can be employed with particular advantage for classification of plain cigarettes which travel from a cigarette rod machine to a filter cigarette machine.

The quality of cigarettes which are produced in a modern high-speed cigarette rod machine depends on operating conditions which prevail at the producing station. Such operating conditions can involve the speed at which the articles are produced. Also, the operating conditions can involve the operation of a trimming device which is usually employed in a cigarette rod machine to remove surplus tobacco from a tobacco stream and to thus convert the stream into a filler rod which is thereupon wrapped into cigarette paper to form a wrapped rod ready to be subdivided by a cutoff to yield sections or plain cigarettes of unit length of multiple unit length. If the cutting element or elements of the trimmer are improperly positioned or if the density of the stream varies, successive increments of the filler will contain different amounts of tobacco, i.e., the tobacco rod sections will be too light or too heavy. It is desirable to segregate from satisfactory cigarettes all such cigarettes which are clearly defective as well as all such cigarettes which are likely to be defective because they are produced when the operating conditions at the producing station are conducive to or indicative of the production of defective or potentially defective articles. The segregation is preferably completed before the cigarettes reach the next processing station because all work which is performed for further processing of defective cigarettes is wasted and such work might entail additional losses in valuable material, particularly when a defective cigarette rod section is united with a filter tip to form therewith a defective filter cigarette which must be ejected or otherwise segregated before it reaches the consumer.

British Patent No. 994,035 discloses a mechanical ejector device which is designed to expel reject cigarettes from a cigarette making machine. The ejector device is installed between the outlet of the cigarette making machine and a transfer drum and is set in operation whenever the machine is operated at less than normal speed. A drawback of such proposal is that the ejector device is likely to deform, change the orientation and/or otherwise affect the appearance, position or condition of the first cigarette which is intended to enter the transfer drum. The first cigarette is then likely to block the path of movement of next-following cigarettes and/or to interfere with proper operation of the processing machine which receives cigarettes from the transfer drum. This can cause substantial losses in output and/or damage to the processing machine.

SUMMARY OF THE INVENTION

An object of the invention is to provide a method of classifying cigarettes or analogous rod-shaped articles which are transported from a producing station to a processing station in such a way that all defective or potentially defective articles are segregated from satisfactory articles and that such segregation of defective or potentially defective articles cannot affect the appearance, condition and/or orientation of those articles which should reach the processing station.

Another object of the invention is to provide a method according to which segregation of defective articles and termination of segregation can take place automatically as a function of changes in operating conditions prevailing at the producing station.

A further object of the invention is to provide an apparatus which can be utilized in the practice of the above outlined method and is particularly suited to classify cigarettes which are transported from a cigarette rod machine to a filter cigarette machine or to another destination.

Still another object of the invention is to provide an apparatus which can be adjusted so as to bring about segregation of all defective articles (whereby the defects of such articles may be due to one, two or more factors, such as the speed of production, excessive amounts of tobacco, insufficient amounts of tobacco, defective wrappers and/or others) as well as segregation of desired numbers of potentially defective articles which are to be segregated to avoid the likelihood of further processing of articles which are not in an optimum condition for additional treatment or whose processing will not result in the manufacture of high-quality products.

One feature of the present invention resides in the provision of a method of classifying cigarettes or analogous rod-shaped articles which comprises the steps of producing a succession of rod-shaped articles at a first station (for example, at a station which accommodates a cigarette rod machine) under different sets of operating conditions at least one set of which is at least conducive to production of defective articles (for example, the first batch of articles produced by a cigarette rod machine is often defective because that length of filler rod which was produced immediately prior to an interruption of operation is too dry, because the seam on the wrapper which is produced immediately following the resumption of operation is formed by partly dried adhesive and/or because the heat-sealing unit of the wrapping mechanism requires a certain period of time before it heats the freshly formed seam to optimum temperature), transporting the thus-produced articles along a predetermined path toward a second station where the articles are subjected to a further treatment (such second station may accommodate a filter cigarette machine which unites sections of a wrapped tobacco rod constituting the aforementioned articles with filter tips by means of adhesive-coated uniting bands), and individually removing from the path those articles which are produced when the one set of (unsatisfactory or potentially unsatisfactory) operating conditions prevails at the first station. The removing step comprises ejecting or otherwise removing from the path articles at the same rate at which the articles are produced under the one set of operating conditions. Such mode of removing insures that ejection of a preceding article does not affect the appearance, orientation, speed of movement and/or condition of the next-following article or articles so that an article which is intended to reach the second station can reach the second station in optimum condition, at a predetermined time, and in a predetermined position best suited for further treatment at the second station.

The aforementioned sets of operating conditions may involve the production of articles at different rates of speed, and at least one rate of speed is normally conducive to or indicative of the production of defective articles. For example, a cigarette rod machine which occupies the first station can be started at a lower speed and is thereupon accelerated to normal operating speed. It is often desirable to expel from the path those articles which remained therein subsequent to interruption of the production and/or one or more of the first or foremost articles which are produced when the cigarette rod machine is started at the lower speed, while the machine operates at lower speed and/or while the machine is being accelerated from lower to normal operating speed.

The ejecting step preferably includes pneumatically ejecting articles from the path between the first and second stations, for example, by streams of compressed air or by another suitable fluid, which are timed to effect ejection of articles under the one set of unfavorable or unsatisfactory operating conditions.

It is also within the purview of the present invention to monitor the path to detect the presence of articles which are produced at the first station upon resumption of interrupted production of articles and to terminate the removal of articles upon detection of a predetermined article which is produced upon resumption of operation. This insures that all articles which were produced prior to resumption of operation are removed from the path ahead of the second station and can also insure removal of one or more freshly produced articles, i.e., of one or more articles which are produced upon resumption of operation.

The further treatment to which the articles are subjected at the second station can be regulated in dependency on operating conditions prevailing at the first station. The regulating step may include monitoring the path to detect the presence of articles which are produced under a set of satisfactory operating conditions and starting the further treatment with a predetermined delay following detection of such articles so that the foremost satisfactory article or articles can reach a predetermined position at the second station before the further treatment begins. If the articles are sections of a wrapped tobacco-containing rod (e.g., sections of a wrapped cigarette rod), the further treatment may include uniting the sections with filter tips, preferably in such a way that each filter tip is placed between and united with two coaxial sections by means of an adhesive-coated uniting band. The uniting operation is then started when the foremost satisfactory article or articles reach the second station and assume a predetermined position at such station.

If desired or necessary, the method may include the additional step of removing from the path at least the foremost one of those articles which are produced at the first station subsequent to a changeover from the one set of operating conditions to a set of satisfactory operating conditions. If the sets of operating conditions involve the production of articles at different rates of speed of which at least one first rate of speed is conducive to production of defective articles and at least one second rate of speed is conducive to or indicative of the production of satisfactory articles, the additional step may comprise removing from the path at least the foremost one of those articles which are produced at the second rate of speed to make sure that only satisfactory articles can reach the second station. However, the foremost article may be the first article which is produced upon resumption of production at the first station.

BRIEF DESCRIPTION OF THE DRAWING

FIG. 2 illustrates the details of the electric circuit in the apparatus which embodies the structure of FIG. 1;

FIG. 4 is a fragmentary side elevational view of a portion of a third apparatus, further showing the electric circuit of the third apparatus;

DESCRIPTION OF THE PREFERRED EMBODIMENTS

Figure 1A:
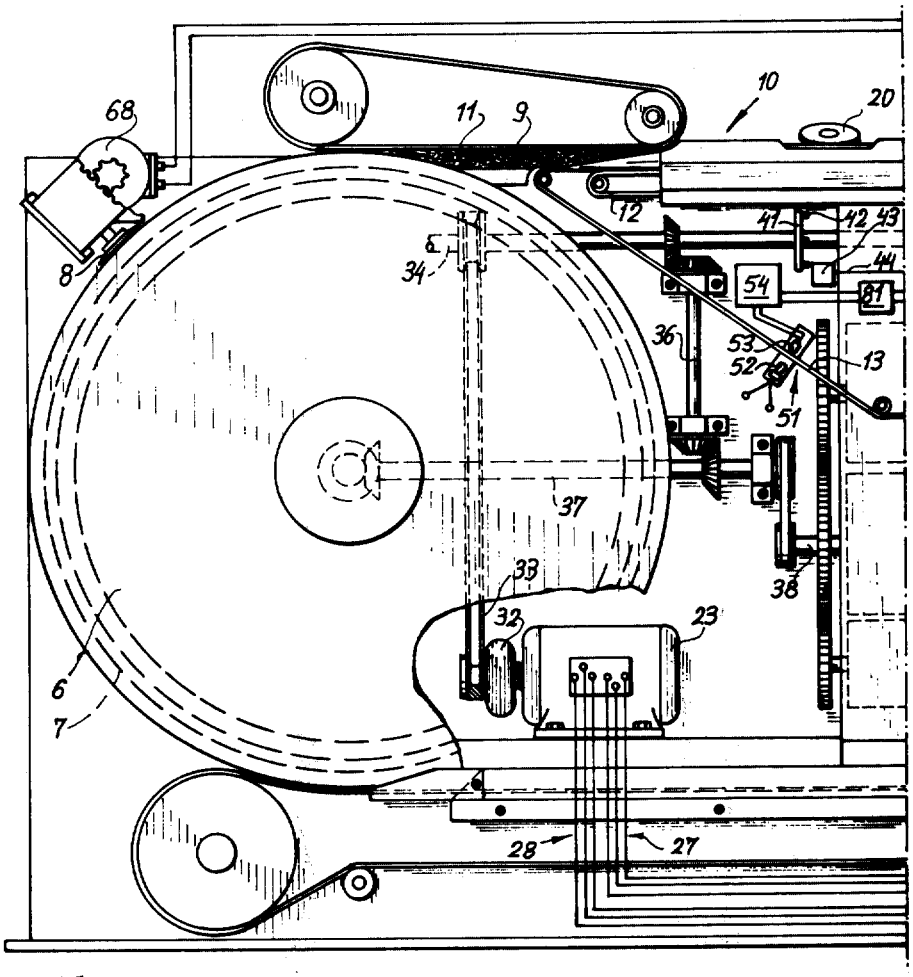
FIG. 1 (composed of FIGS. 1*a* and 1*b*) is an elevational view of a portion of an apparatus which embodies one form of the invention and wherein the removal of defective articles is effected in dependency on a plurality of conditions which affect the quality of articles.
Figure 1B:
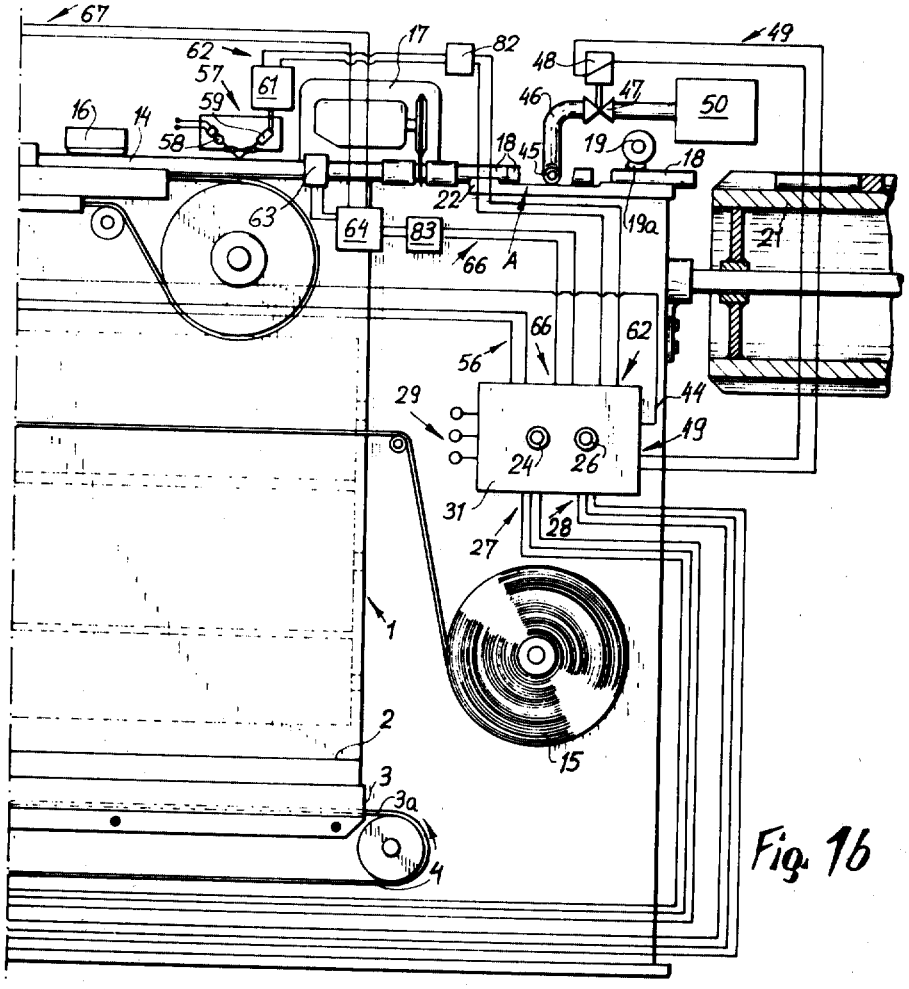

Referring to FIG. 1, there is shown a cigarette rod machine which occupies a first or producing station and comprises a tobacco source here shown as a distributor 1 which discharges shredded tobacco in the form of a uniform shower descending onto a wide belt 2. The latter accumulates a wide carpet or mat of tobacco particles and feeds the carpet substantially at right angles to the plane of FIG. 1 whereby the leading edge of the carpet descends onto a narrow perforated tobacco stream-forming belt 3*a* which is trained over several rollers 4 one of which is driven to advance the resulting narrow tobacco stream lengthwise in a direction to the left, as viewed in FIG. 1. The upper stretch of the belt 3*a* is flanked by side walls 3 which define therewith a channel and confine the sides of the tobacco stream. During travel with the upper stretch of the belt 3*a*, the tobacco stream is held by suction which is effective through the perforations of the belt. The leading end of the tobacco stream is delivered into the circumferential groove 7 of a further conveyor here shown as a wheel 6 (FIG. 1*a*) which is rotated in a vertical plane and accommodates a stationary suction chamber to hold the tobacco particles in the groove 7 while the particles advance toward and past an adjustable trimming or equalizing device 8 which removes the surplus and converts the stream into a trimmed filler rod 9. The latter is thereupon transported along the lower stretch of an endless presser band 11 and onto the upper stretch of an endless garniture tape or belt 12 which forms part of a wrapping mechanism 10 and receives a continuous web or tape 13 of wrapping material (cigarette paper) from a bobbin or reel 15 (FIG. 1*b*). The mechanism 10 converts the filler rod 9 into a wrapped cigarette rod 14 and further comprises a paster including a roller-shaped applicator 20 (FIG. 1*a*) which provides one or both longitudinal edges of the web 13 with a coat of adhesive. The two edges are then caused to overlie each other so that they form a seam which is heated by a sealer plate 16 (FIG. 1*b*). The latter also applies a requisite mechanical pressure and thus insures that the seam can withstand the pressure of compacted tobacco in the filler 9. The wrapping mechanism 10 is located upstream of an article-producing device or cutoff 17 (FIG. 1*b*) which includes an orbiting knife serving to sever or subdivide the cigarette rod 14 at predetermined intervals so that the rod yields a succession or series of wrapped cigarette rod sections 18 of unit length or multiple unit length. The sections 18 advance below an accelerating device or kicker 19 (FIG. 1*b*) which includes an eccentric wrapper-engaging portion 19*a* serving to separate successive sections from each other and to propel them into successive flutes of a revolving transfer drum 21. The latter transports the sections 18 to a second or processing station, for example, to a station which accommodates a filter cigarette machine, a mechanism which transfers sections 18 into trays, a packing machine, or another processing unit.

The apparatus further comprises guide means 22 (FIG. 1*b*), here shown as a prismatic trough, which is disposed at a level below the cutoff 17 and guides the sections 18 along a straight path toward, past and beyond the accelerating device 19.

The prime mover of the cigarette rod machine comprises a pole-reversible polyphase asynchronous electric motor 23 (FIG. 1*a*) which is operable at several speeds, for example, at a lower speed and at a higher (normal) speed. The means for starting the motor 23 at the two speeds comprises starter switches 24, 26 which are mounted on a control panel 31 (FIG. 1*b*) and are respectively connected with the corresponding windings of the motor by conductors 27, 28. The source of polyphase current is shown at 29. The output shaft of the motor 23 drives the primary element of a fluid coupling 32 (FIG. 1*a*). The secondary element of this coupling carries a sheave for one or more endless V-belts 33. These belts drive a main drive shaft 34 of the cigarette rod machine and the shaft 34 transmits motion to additional shafts including those numbered 36, 37 and 38 (FIG. 1*a*). The shaft 36 drives the shaft 37 which serves to rotate the suction wheel 6. The shaft 37 drives the shaft 38 which operates the distributor 1.

The main drive shaft 34 carries a disk-shaped timer 41 (FIG. 1*a*) which rotates at the speed of (or at a speed which is proportional to) the speed of the cigarette rod machine and is provided with a circular array of equidistant permanent magnets 42. A signal generator 43 is adjacent to the timer 41 and comprises an induction coil which produces a pulse in response to travel of successive magnets 42 therealong. A conductor 44 transmits signals from the signal generator 43 to the control panel 31. The distance between the magnets 42 is such that the length of intervals between the generation of successive signals suffices to transport the cigarette rod 14 lengthwise by the length of a section 18.

FIG. 1*b* shows that the aforementioned trough or guide means 22 comprises a shallower central portion (as at A) which is located upstream of the accelerating device 19 and defines an ejecting station where defective and/or potentially defective sections 18 are removed from the path of satisfactory sections by a pneumatic removing device or ejector which includes a nozzle 45. This nozzle discharges one or more streams of compressed fluid (preferably air) at right angles to the direction of travel of the cigarette rod 14 and is connected with a source 50 of compressed fluid by a conduit 46 which contains a regulating valve 47. The latter is a solenoid-operated valve and its solenoid is shown at 48. This solenoid is connected with the control panel 31 by conductors 49.

The cigarette rod machine further comprises a detector assembly 51 (FIG. 1*a*) which serves to detect defects of the web 13. This assembly 51 comprises a photosensitive system which can detect splices in the web 13 and includes a light source 52 and a photosensitive receiver 53. The latter is connected with an amplifier 54 which is connected with the control panel 31 by a signal- or pulse shaper (preferably a Schmitt trigger) 81 and conductors 56. The detector assembly 51 produces signals when a splice travels between the light source 52 and receiver 53; each such signal is amplified at 54 and shaped at 81 before it reaches the circuitry in the control panel 31. A similar detector assembly is disclosed, for example, in German Patent No. 1,195,654. It is clear that the assembly 51 can be replaced by a mechanical detector assembly which comprises a mechanical scanner whose sensitivity is sufficient to insure detection of splices in the web 13.

A second detector assembly 57 (FIG. 1*b*) is adjacent to the path for the cigarette rod 14 downstream of the sealer 16. This detector assembly is designed to detect defects in the seam of the tubular wrapper on the cigarette rod 14. It comprises a light source 58 serving to produce a light beam which is directed against the wrapper in the region of the seam whereby the seam reflects the beam against a photosensitive receiver 59 which is connected with the control panel 31 by way of an amplifier 61, a Schmitt trigger 82 or an analogous pulse shaping device, and conductors 62. The detector assembly 57 is designed to produce signals when a portion of the seam bursts open or when tobacco shreds penetrate between the overlapping edges of the web 13 so that they are likely to weaken the corresponding portion of the seam. The operation of the assembly 57 is based on the principle that the reflection of light is less satisfactory when the light beam produced by the source 58 and focussed upon the rod 14 impinges against tobacco particles rather than against cigarette paper.

A third detector assembly 33 (FIG. 1*b*) is installed between the sealer 16 and cutoff 17, preferably downstream of the detector assembly 57. The purpose of the assembly 63 is to determine the quantity of tobacco per unit length of the cigarette rod 14 and to effect ejection of those sections 18 which contain less than a desired amount of tobacco particles. The detector assembly 63 preferably comprises a source of beta rays or a similar source of penetrative radiation and a detector which is connected with an amplifier 64 and a Schmitt trigger 83 or another suitable pulse shaper. The latter is connected with the control panel 31 by conductors 66. The amplifier 64 is further connected with the adjusting motor 68 for the trimming device 8 by conductors 67. The arrangement is such that the trimming device 8 is adjusted as a function of the quantity of tobacco per unit length of the cigarette rod 14, i.e., the knife or knives of the trimming device move away from the groove 7 to produce a filler rod 9 which contains more tobacco per unit length if the detector assembly 63 determines that the cigarette rod 14 contains less than a desired quantity of tobacco particles per unit length, and the motor 68 moves the knife or knives of the trimming device 8 toward the groove 7 to reduce the amount of tobacco per unit length of the filler rod 9 when the assembly 63 ascertains that the rod 14 contains more tobacco then desired. The manner in which the trimming device 8 can be adjusted as a function of changes in quantity of tobacco per unit length of a mass of travelling tobacco particles is disclosed, for example, in U.S. Pat. No. 2,937,280. Pulse shapers which can be utilized in the machine of FIG. 1 are disclosed, for example, in the publication "Elektronik", 1967, Vol. 5, sheet 15. The purpose of such pulse shapers is to produce a predetermined output signal in response to reception of signals which either exceed or are below a predetermined threshold value.

The electric circuit which is installed in and on the control panel 31 is illustrated in FIG. 2. The aforementioned starter switches 24, 26 which respectively initiate operation of the motor 23 at a lower speed and at a normal operating speed are provided with working contacts 24*a*, 26*a* and second contacts 24*b*, 26*b*. Closing of working contacts 24*a*, 26*a* completes the circuits of relays 71, 72 which are energized without delay. Three working contacts 71*a* or 72*a* of the relay 71 or 72 can connect the conductors 27 or 28 for the corresponding windings of the motor 23 with the energy source 29. The relays 71, 72 further comprise holding contacts 71*b*, 72*b*. The second contact 24*b* of the starter switch 24 is connected in the holding circuit of the relay 72 and the second contact 26*b* of the starter switch 26 is connected in the holding circuit of the relay 71. A further working contact 72*c* of the relay 72 is connected in the holding circuit of a time-delay relay 73. The latter comprises a contact 73*a* which is connected in the current-supplying lead of a monostable multivibrator 74. This lead is connected to the input 74*a* of the multivibrator 74. A second input 74*b* of the multivibrator 74 is connected with the aforementioned conductor 44 which is connected with the signal generator 43. The output 74*c* of the multivibrator 74 is connected with the aforementioned conductors 49 which connect it to the solenoid 48 of the regulating valve 47. The purpose of the monostable multivibrator 74 is to produce an output signal of predetermined intensity and duration indpendently of the shape and duration of incoming signals (from the timer means 41–43). A suitable monostable multivibrator is disclosed, for example, in the publication "Grundzuege digitaler Rechenautomaten" by P. Rechenberg, Oldenburg-Verlag, Munich and Vienna, pgs. 100–101.

The numerals 76, 77 and 78 denote in FIG. 2 timer-controlled time-delay signal storing devices whose inputs 76*a*, 77*a*, 78*a* are respectively connected with the conductors 56, 62 and 66, i.e., with the detector assemblies 51, 57 and 63. Second inputs 76*b*, 77*b*, 78*b* of the signal storing devices 76, 77, 78 are connected with the conductor 44 and their outputs 76*c*, 77*c*, 78*c* are connected with the input 74*a* of the monostable multivibrator 74 by conductors 79, 91, 92. The number of stages in the signal storing units 76–78 is respectively proportional to the distance between the nozzle 45 and the detector assemblies 51, 57 and 63, i.e., to the number of sections 18 which can be accommodated between the nozzle 45 and the corresponding detector assemblies. Each signal from the signal generating device 43 causes a signal stored in the signal storing unit 76, 77 or 78 to advance by a step. Thus, a signal which is generated by the detector assembly 51 in response to detection of a splice in the web 13 travels through the corresponding signal storing unit 76 in synchronism with the speed of travel of the splice toward the nozzle 45. Also, a signal received by the signal storing device 77 in response to detection of a defective seam portion on the wrapper of the cigarette rod 14 travels through the signal storing device 77 at a speed which is proportional to the speed of the defective seam portion while the latter advances toward the nozzle 45. Analogously, a signal generated by the assembly 63 in response to detection of an increment of cigarette rod 14 which contains too little or too much tobacco advances through the signal storing device 78 in synchronism with the speed of travel of the corresponding increment toward the nozzle 45. Such signals reach the respective outputs 76*c*, 77*c*, 78*c* when the corresponding (defective) sections 18 reach the nozzle 45. The characters 76*d*, 77*d*, 78*d* respectively denote the current supplying connections of the signal storing devices 76, 77, 78. Devices of such a kind are disclosed, for example, in the aforementioned publication entitled "Grundzuege digitaler Rechenautomaten" (refer to pages 97 and 98).

The operation:

In order to start the cigarette rod machine, the operator closes the starter switch 24. This energizes the relay 71 which changes the position of its contacts 71*a*, 71*b* whereby the motor 23 accelerates the machine so that the latter operates at the lower of two speeds. The operating conditions at the station accommodating the cigarette rod machine are then such that the machine is at least likely to produce or to furnish defective sections 18 into the path defined by the trough 22. When the operator releases and thus opens the starter switch 24, the relay 71 remains energized because its holding contact 71*b* is closed. The shaft 34 is rotated by the motor 23 by way of the coupling 32 and belt 33 whereby the timer disk 41 rotates with the magnets 42 and the device 43 generates signals at intervals which are indicative of the momentary speed of the machine. Such signals are transmitted via conductor 44 to the input 74*b* of the monostable multivibrator 74. Since the relay 73 is deenergized, the input 74*a* of the multivibrator 74 receives current so that each signal transmitted to the multivibrator 74 by the conductor 44 causes the multivibrator to transmit a signal by way of the output 74*c* and conductors 49. Such signals energize the solenoid 48 which opens the regulating valve 47 whereby the streams of compressed air discharged by the nozzle 45 individually eject successive sections 18 from the shallower portion A of the trough 22. The same procedure is repeated as long as the machine operates at the lower speed because the signal generator 43 transmits a signal whenever one of the permanent magnets 42 on the timer disk 41 assumes a predetermined angular position, i.e., whenever a freshly severed section 18 reaches the ejecting station which accommodates the nozzle 45. It will be noted that the ejection of sections 18 takes place in a predetermined portion of the path in which satisfactory and defective sections travel toward the discharge end of the machine. This predetermined portion of the path is that portion where the sections 18 are in an optimum position for expulsion from the trough 22 by short-lasting streams of compressed air admitted into the nozzle 45 in response to opening of the regulating valve 47. Such optimum position is that position in which a section 18 can be ejected or removed without affecting the speed, appearance, condition and/or orientation of the next following section or sections. It is clear, however, that FIG. 1 illustrates only one of several advantageous positions of the ejecting station. IF desired, such station can be provided downstream of the accelerating device 19 or transfer 21, for example, in a filter cigarette machine which is located at a second station and receives satisfactory sections 18 from the drum 21. It is also possible to provide a single ejecting station which accommodates the nozzle 45 or an analogous ejecting or removing device whereby the ejecting device can respond to signals from the monostable multivibrator 74 as well as to signals which are transmitted thereto by a conventional testing device such as that which is often employed in a filter cigarette machine to test the density of ends of tobacco rod sections in filter cigarettes, to test the condition of wrappers, to test the condition of joints between the filter tips and tobacco rods of filter cigarettes and/or to test another characteristic of intermediate or final products which are obtained in a filter cigarette machine.

If the operator thereupon decides to close the starter switch 26, the latter closes its contact 26*a* and thereby energizes the relay 72. At the same time, the switch 26 opens its normally closed contact 26*b* which opens the holding circuit of the relay 71 whereby the contacts of the relay 71 return to the positions shown in FIG. 2. The operator thereupon releases the starter switch 26; however, the relay 72 remains energized because its holding contact 72*b* is closed. The contacts 72*a* are closed. The contacts 72*a* of the energized relay 72 connect the corresponding winding of the motor 23 with the energy source 29 whereby the machine is driven at normal operating speed. Thus, the operating conditions at the station accommodating the cigarette rod machine are then conductive to production of satisfactory sections 18. During acceleration to normal operating speed, the timer means 41–43 continues to transmit signals to the monostable multivibrator 74 by way of the conductor 44 and input 74*a*. Therefore, the multivibrator 74 continues to effect intermittent energization of the solenoid 48 and ejection of successively formed sections 18 from the trough 22 as long as the relay 73 remains deenergized. Energization of relay 73 results in movement of contact 73*a* to open position whereby the contact 73*a* interrupts the connection between the input 74*a* and the current source for the multivibrator 74. The delay with which the relay 73 is energized following energization of the relay 72 is preferably selected in such a way that the monostable multivibrator 74 ceases to send signals to the solenoid 48 with a delay which suffices to insure that all defective or potentially defective sections 18 which were produced during operation at lower speed and during acceleration to normal operating speed have reached the station A and were ejected by the nozzle 45. From then on, sections 18 which are obtained subsequent to energization of the time-delay relay 73 travel past and beyond the ejector nozzle 45 and are accelerated at 19 to be propelled into successive flutes of the transfer drum 21. Such situation prevails until and unless at least one of the detector assemblies 51, 57, 63 detects a defect in the web 13, in the wrapper of the rod 14 or in the filler of the rod 14.

If one of the detector assemblies 51, 57, 63 produces a signal, such signal is transmitted to the respective signal storing device 76, 77 or 78 and advances stepwise through the corresponding signal storing device in synchronism with travel of the defective portion of the web, wrapper or filler toward the ejecting station. As stated before, the travel of signals through successive stages of the signal storing devices 76, 77, 78 is initiated by signals from the timer means 41–43 (conductor 44). The outputs 76*c*, 77*c*, 78*c* transmit to the input 74*a* of the monostable multivibrator 74 signals when the corresponding defective sections 18 reach the ejecting station whereby the multivibrator transmits a signal which energizes the solenoid 48 to open the regulating valve 47 and to effect expulsion of defective section 18 from the trough 22. The detector assembly 51, 57 and/or 63 can transmit signals intermittently or continuously. For example, the assembly 63 can produce signals during an extended interval of time if a substantial length of the filler 9 contains too much or too little tobacco. The nozzle 45 then ejects a succession of sections 18, one after the other, as long as the multivibrator 74 continues to receive signals from the signal storing device 78. The ejection of defective sections 18 takes place individually, i.e., when a defective section is in an optimum position for ejection or segregation without affecting the appearance, speed, condition and/or orientation of adjoining (preceding and/or next following) sections. Ejection of defective or potentially defective sections sideways (namely, at right angles to the direction of lengthwise travel of articles in the trough 22) is desirable because the sections enter the station A by moving axially lengthwise. If the ejecting station is adjacent to the transfer drum 21 or to a portion of the path where the sections 18 travel sideways, defective sections can be expelled lengthwise.

The operating speed of the cigarette rod machine is one of the most important factors which can affect the condition and quality of cigarette rod sections 18. A modern high-speed cigarette making machine which is designed to produce at least 2,000 plain cigarettes per minute at normal operating speed is particularly sensitive to changes in speed, especially to a reduction of speed below normal operating speed. The machine speed is less than normal operating speed when the machine is started or when the machine requires adjustment, for example, to introduce the leading end of a fresh web 13, to replenish the supply of adhesive in the paster of the wrapping mechanism 10 or for another reason. Sections 18 which are produced during such low-speed operating are likely to be defective, and the apparatus which includes the structure of FIGS. 1 and 2 automatically segregates all sections which are produced before the cigarette rod machine begins to operate at normal speed. This also includes ejection of sections 18 which remained in the machine after stoppage and which begin to advance toward the station A on resumption of operation at lower speed. As will be described in connection with FIG. 5 and 7, the apparatus of our invention can be designed to eject only one section or a few sections which are produced upon resumption of operation of the cigarette rod machine, i.e., the apparatus can segregate from satisfactory sections those sections which might have been left in the path between the cigarette rod machine and the processing machine for sections 18 as well as one section or a few sections wich are produced on resumption of operation of the cigarette rod machine.

Figure 3:
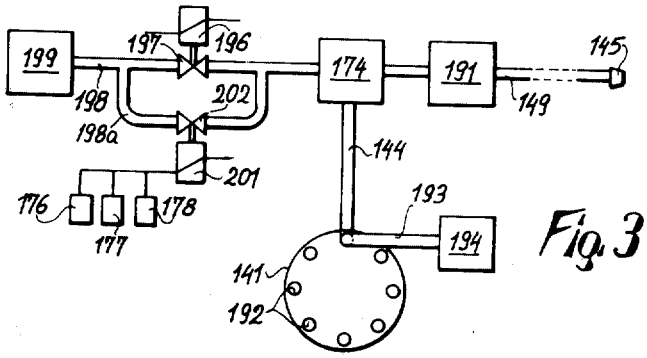
FIG. 3 illustrates a portion of a second apparatus wherein the electric circuit of FIG. 2 is replaced by a system which includes pneumatic and electrical components.

FIG. 3 illustrates a portion of a modified apparatus wherein the removing or ejector nozzle 145 receives compressed air by way of a pneumatic amplifier 191 which replaces the solenoid-operated valve 47 of FIG. 1 and is controlled by a pneumatic monostable multivibrator 174. The disk-shaped timer 41 of FIG. 1 is replaced by a disk-shaped timer 141 which is provided with a set of openings 192 travelling seriatim between the discharge end of a supply conduit 193 which is connected with a source 194 of compressed air and the receiving end of a conduit 144 which replaces the conductor 44 and serves to transmit pneumatic timing signals to the multivibrator 174.

The time-delay relay 73 of FIG. 2 is replaced by a time-delay solenoid 196 which controls a regulating valve 197 in a conduit 198 replacing the conduit 46 of FIG. 1. The numeral 199 denotes a source of compressed air which is connected with the intake end of the conduit 198. The outputs of three signal storing devices 176, 177, 178 are connected in the energizing circuit of a solenoid 261 which controls a second regulating valve 202 installed in a branch conduit 198*a* which by-passes the regulating valve 197. Pneumatic monostable multivibrators and pneumatic amplifiers which can be utilized in the machine of FIG. 3 are manufactured by Corning Glass Works, of Corning, New York 14830 and are respectively sold under the name "variable one shot fluidic multivibrators" (see the Catalog dated November 1966, Item No. 190,895) and under the name "proportional devices" (see the Catalog dated May 1966, Item No. 190,878).

The operation of the apparatus which embodies the structure of FIG. 3 is as follows.

Referring simultaneously to FIGS. 1, 2 and 3 when the relay 72 of FIG. 2 is deenergized (closed position of the starter switch 26), the solenoid 196 of FIG. 3 remains deenergized so that the regulating valve 197 is open and the conduit 198 can transmit a continuous signal (compressed air) to the corresponding input of the pneumatic monostable multivibrator 174. The conduit 198 thus corresponds to the aforementioned current supplying lead to the input 74*a* of the monostable multivibrator 74 shown in FIG. 2. The multivibrator 174 further receives signals from the timer disk 141 by way of the conduit 144 whereby the signals at each of its inputs cause the multivibrator 174 to transmit signals to the amplifier 191 which admits compressed air to the conduit 149 and thus to the nozzle 145 which ejects each successively formed section 18.

If the operator closes the starter switch 26, the relay 72 of FIG. 2 is energized and energizes the solenoid 196 which closes the regulating valve 197 whereby this valve seals the source 199 from the pneumatic monostable multivibrator 174. Thus, even though the conduit 144 continues to send signals whenever one of the openings 192 moves into the gap between the conduits 193, 144, the multivibrator 174 does not produce any output signals and the amplifier 191 does not permit entry of compressed air into the ejector nozzle 145 provided, of course, that the sections 18 are free of defects. If one of the detector assemblies 51, 57, 63 (FIG. 1) produces a signal which indicates the presence of a splice, a defective seam or a defective filler, the signal is transmitted to the signal storing device 176, 177 or 178 which transports the signal in a manner as described in connection with FIG. 2 and energizes the solenoid 201 when the corresponding section 18 reaches the ejecting station (nozzle 145). The manner in which electrical signals furnished by the devices 51, 57 63 can be converted into pneumatic signals or vice versa is well known in the art. The transducer which converts pneumatic signals furnished by the devices 176, 177, 178 into electric signals serving to energize the solenoid 201 is not shown in FIG. 3. The solenoid 201 opens the valve 202 which admits fluid from the source 199 to the multivibrator 174 whereby the latter sends an output signal in response to reception of a signal by way of the conduit 144.

An advantage of the apparatus which includes the structure of FIG. 3 is that the solenoid 48 of FIG. 1 is dispensed with. Repeated energization and deenergization of a solenoid at speeds required in a modern cigarette making machine presents ferious problems.

FIG. 4 illustrates a portion of a third apparatus, namely, that portion of a cigarette rod machine which is located between the producing means or cutoff 217 and the transfer drum 221. This Figure further shows a modified electric circuit which includes a pole-reversible polyphase asynchronous electric motor 223. The latter constitutes the main prime mover of the cigarette rod machine. All such parts of the structure shown in FIG. 4 which are clearly analogous to the parts of the cigarette rod machine shown in FIG. 1 are denoted by similar reference numerals plus 200. The cutoff 217 is installed downstream of a wrapping mechanism which includes the garniture tape 212. A prismatic guide in the form of a trough 222 is installed on the machine frame downstream of the cutoff 217 and serves to guide successive wrapped cigarette rod sections 218 along a predetermined path toward a processing machine. At the ejecting station A, the trough 222 is provided with lateral cutouts to permit ready ejection of defective or potentially defective sections 218. Each section 218 which advances beyond the station A is accelerated by the kicker 219 and is propelled into one of the peripheral flutes in the transfer drum 221. The ejecting or removing device comprises a nozzle 245 which is adjacent to the trough 222 and is controlled by a rotary mechanical timer or interrupter device which interrupts the delivery of compressed air to the nozzle. This mechanical timer device comprises a disk or wheel 501 which is installed between the orifice of the nozzle 245 and the path of sections 218 in the trough 222 and is formed with an aperture 502 for compressed air. The drive for the timer disk 501 comprises a shaft 403, a pair of mating spur gears 404, a shaft 406 which is driven by the larger gear 404, and a pair of mating bevel gears 407. This drive derives motion from the cutoff 217 so that rotary movements of the disk 501 are synchronized with orbital movements of the knife in the cutoff. The aperture 502 of the disk 501 registers with the orifice of the nozzle 245 when a cigarette rod section 218 occupies the ejecting station A in an optimum position for removal from the path. It is clear that the disk 501 can be provided with two or more apertures 502; the drive is then designed in such a way that one of the apertures registers with the nozzle 245 whenever a section 218 enters the station A. conduit 246 which connects the nozzle 245 with a source 250 of compressed air contains a regulating valve 247 which is open whenever the machine is operated at a reduced speed and which is controlled by a solenoid 248. The valve 247 is open when the solenoid 248 is energized. This solenoid is connected with conductors 249 forming part of the aforementioned circuit which is mounted in and/or on a control panel 231. The circuit further comprises a first starter switch 224 which can start the motor 223 at a lower speed and a second starter switch 226 which can accelerate the motor 223 to normal operating speed. These switches respectively comprise working contacts 224*a*, 226*a* and second contacts 224*b*, 226*b*. The contacts 224*a*, 226*a* are in circuit with relays 271, 272 which are energizable with minimal delay. These relays have working contacts 271*a*, 272*a* three of which can respectively connect the conductors 227, 228 with the energy source 229 to bring about operation of the motor 223 at the lower speed or at the normal operating speed. The reference characters 271*b* and 227*b* denote the holding contacts of the relays 271, 272. The holding circuit of the relay 272 includes the second contact 224*b* of the starter switch 224. The second contact 226*b* of the starter switch 226 is connected in the holding circuit of the relay 271. A working contact 272*c* of te relay 272 is connected in circuit with a time-delay relay 273 which has a contact 273*a* in circuit with the solenoid 248 for the regulating valve 247. The idle positions of contacts in the relays in the circuit of FIG. 4 are shown by solid lines and their working positions are indicated by broken lines.

The operation:

The cigarette rod machine is started to resume operation by closing the first starter switch 224. This energizes the relay 271 which moves its contacts 271*a*, 271*b* to the broken-line positions of FIG. 4. The motor 223 accelerates the machine to a lower speed. When the switch 224 is released, the contact 271*b* insures that the relay 271 remains energized. The relay 273 is still deenergized so that its contact 273*a* remains closed and the solenoid 248 is energized to maintain the regulating valve 247 in open position. This enables the nozzle 245 to eject each successive cigarette rod section 218 because the stream of compressed air issuing from the orifice of the nozzle 245 can pass through the aperture 502 of the timer disk 501 whenever a section 218 enters the ejecting station A. Thus, the disk 502 insures that the stream of compressed air issuing from the nozzle 245 can enter the transfer station A only when this station accommodates a cigarette rod section 218 in an optimum position for removal. The timer disk 501 is designed and rotated in such a way that the discharge of compressed air by the nozzle 245 into the station A takes place at predetermined intervals, i.e., in synchronism with operation of the cutoff 217 and with such a delay following severing of a fresh section 218 from the wrapped cigarette rod 214 that such section has time to move from the cutoff to the station A before the aperture 502 permits a stream of compressed air to enter the transfer station.

The operator thereupon depresses the second starter switch 226 to energize the relay 272 which opens the second contact 272*b* to thereby deenergize the holding circuit of the relay 271, i.e., the contacts 271*a*, 271*b* of the relay 271 return to the solid-line positions of FIG. 4. The contacts 271*a*, 272*b*, 272*c* move to the broken-line positions. When the switch 226 is released, the relay 272 remains energized because its holding circuit is completed by the contact 272*b*. The contacts 272*a* connect the conductors 228 with the energy source 229 so that the motor 223 is accelerated to and thereupon rotates at normal operating speed. The solenoid 248 remains energized during acceleration of the motor 223 to normal operating speed so that the nozzle 245 continues to eject sections 218 which are formed during such acceleration. This is due to the fact that the delay with which the relay 273 is energized in response to closing of the contact 272*c* is selected in such a way that the delay suffices to insure that the motor 223 is accelerated to normal operating speed prior to energization of the relay 273. When energized, the relay 273 opens the contact 273*a* and deenergizes the solenoid 248 so that the regulating valve 247 closes and interrupts the flow of compressed air from the source 250 to the nozzle 245. The delay with which the relay 273 is energized is preferably too long rather than too short to insure that the motor 223 is accelerated to full operating speed before the solenoid 248 initiates closing of the regulating valve 247.

An important advantage of the apparatus which embodies the structure of FIG. 4 is that the regulating valve 247 can remain open longer than necessary to bring about explusion of a defective or potentially defective cigarette rod section 218 from the path defined by the trough 222. This is due to the fact that the apparatus includes the timer disk 501 which determines the length of intervals during which compressed air can pass through the aperture 502 when a defective or potentially defective section 218 occupies the ejecting station. When the sections 218 are transported at a very high speed, opening of the valve 247 at the exact intervals and for the exact periods of time which are needed to insure that the defective section is removed without affecting the appearance, condition, speed and/or orientation of adjoining section or sections presents considerable problems. Thus, even minor delays in energization of the solenoid 248 due to inertia might affect the timing of ejection so that the stream of air issuing from the nozzle 245 in the absence of the timer disk 501 might exert an undesirable influence on satisfactory sections which precede or follow the defective section.

Figure 5:
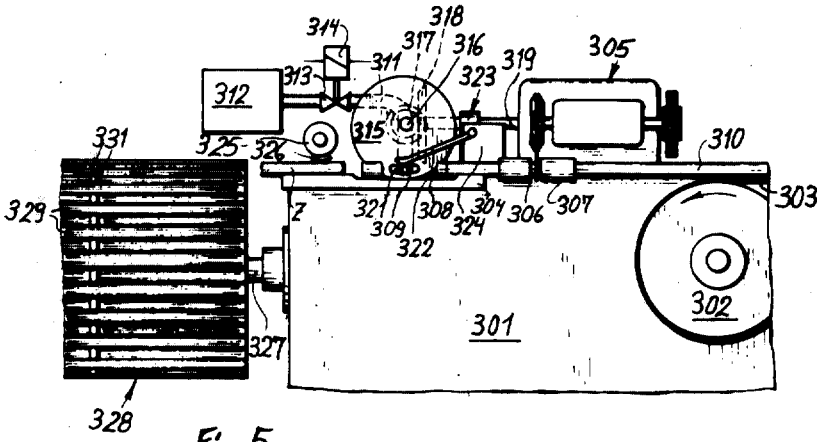
FIG. 5 is a fragmentary elevational view of the producing machine in a fourth apparatus.

FIG. 5 illustrates a portion of a cigarette rod machine which includes a frame 301 supporting a roller 302 for the garniture tape 303 of the wrapping mechanism. The wrapped cigarette rod is shown at 310, the cutoff at 305, the transfer drum at 328, the accelerating device or kicker at 325, and the U-shaped guide member or trough at 304. This trough receives successive cigarette rod sections Z which are severed from the rod 310 by the orbiting knife 306 of the producing means or cutoff 305. A tube 307 guides the rod 310 at the severing station; this tube registers with the trough 304 and has a slot for the orbiting knife 306. The trough 304 has an elongated cutout 308 which is located at the ejecting station and enables the sections Z to leave the trough sideways in response to discharge of compressed air from the orifice of an ejecting or removing nozzle 309. This nozzle is installed midway between the longitudinal ends of the cutout 308 and receives compressed air by way of supply conduit 311 which is connected with a source 312. The conduit 311 accommodates a regulating valve 313 which is controlled by a solenoid 314. A timer disk 315 is mounted between the cutout 308 and the orifice of the nozzle 309 and is provided with an arcuate aperture or slot 321 which registers with the orifice of the nozzle whenever a section Z enters the transfer station. The shaft 316 of the timer disk 315 carries a bevel gear 317 in mesh with a second bevel gear 318 on a shaft 319 which is driven by the cutoff 305 so that rotation of the disk 315 is synchronized with orbital movement to the knife 306.

The arm 322 of a monitoring device or detector 323 is adjacent to the nozzle 309 at a level above the cutout 308 of the trough 304. The purpose of the monitoring device 323 will be described in connection with FIG. 7. The detector 323 further includes a housing 324 for certain control elements.

Figure 6:
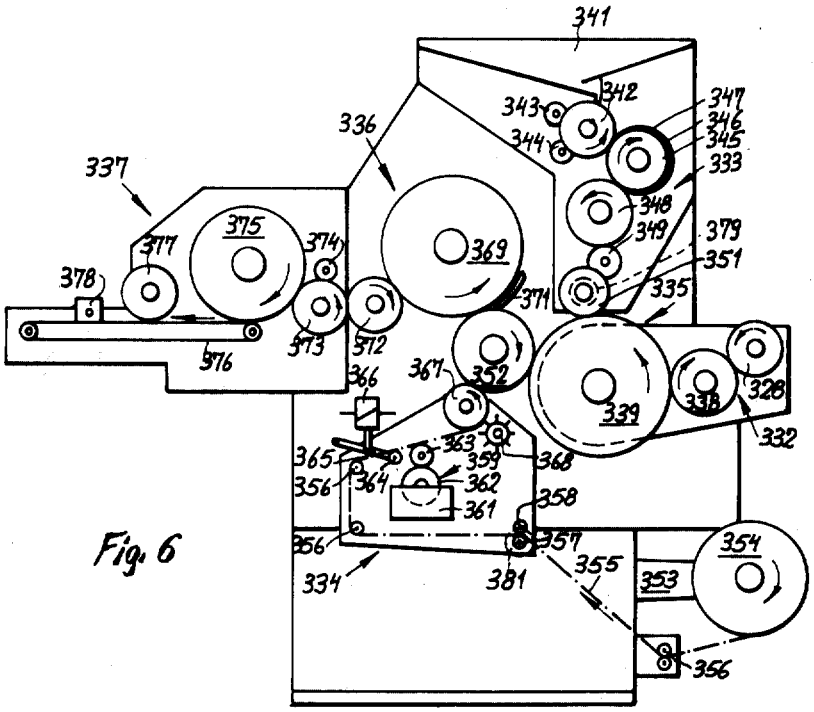
FIG. 6 is an elevational view of the processing machine in the fourth apparatus.

The aforementioned accelerating device 325 has an eccentric wrapper-engaging portion or lobe 326 which propels successive cigarette rod sections Z into the adjoining flutes 329 of the revolving transfer drum 328. These flutes accommodate stops 331 for the leading ends of sections Z. The diameter of a section Z exceeds the minimal distance between the lobe 326 and the bottom of the groove in the adjoining part of the trough 304 so that each section Z which travels past the accelerating device 325 is automatically propelled into one of the flutes 329. The operation of the device 325 is synchronized with that of the cutoff 305. The shaft 327 of the transfer drum 328 is parellel to the cigarette rod 310. The stops 331 shown in FIG. 5 are provided in each second flute 329 of the transfer drum 328. This drum is longer than shown in FIG. 5, i.e., it extends to the left and the remaining flutes 329 also accommodate stops (not shown) which arrest sections Z in such axial positions that the drum 328 accumulates and transports two rows of sections Z toward a processing station. The drum 328 may form part of filter cigarette machine, for example, a machine which is shown in FIG. 6 and serves to produce filter cigarettes of unit length. The filter cigarette machine comprises a first feeding unit 332 which delivers pairs of axially spaced cigarette rod sections Z of unit length and includes the aforementioned transfer drum 328, a second feeding unit 333 which supplies filter tips of double unit length, a pasting unit 334 which supplies adhesive-coated uniting bands serving to unite each pair of axially spaced cigarette rod sections Z with a filter tip of double unit length to form a filter cigarette of double unit length, a wrapping or convoluting unit 336 which convolutes the uniting bands around the corresponding filter tips and around the adjoining ends of sections Z, and a removing unit 337 which removes finished filter cigarettes. The numeral 335 denotes an assembly station where successively supplied pairs of cigarette rod sections Z (unit 332) are shuffled with filter tips of double unit length (supplied by unit 333) to form assemblies each of which includes a centrally located filter tip flanked by two sections Z.

The feeding unit 332 includes the transfer drum 328 which transfers two rows of sections Z to a pair of coaxial aligning drums 338 (only one shown) rotating at different speeds so that the sections Z of one row (on one of the drum 338) are brought into axial alignment with sections Z of the other drum 338 before they reach a transfer point between the drums 338 and an assembly drum 339 at the station 335. The latter receives filter tips of double unit length from the feeding unit 333. The unit 333 comprises a magazine or hopper 341 for filter rods. This magazine has an outlet which discharges filter rods into the flutes of a revolving cutting drum 342 cooperating with two axially staggered rotary disk-shaped cutters 343, 344. The rods in the magazine 341 are of sextuple unit length and the cutters 343, 344 subdivide each rod into three coaxial filter tips of double unit length. Each filter tip is delivered into a flute of one of three staggering drums 345, 346, 347 which rotate at different speeds or transport the filter tips through distances of different length so that the filter tips obtained on subdivision of each rod are shifted sidewise with reference to each other before they enter successive flutes of an aligning drum 348. The distance between the flutes in each of the staggering drums 354–347 and between the flutes in each of the cutting drum 342 is the same. The distance between the flutes of the aligning drum 348 is one-third of the distance between the flutes of the drum 342, and this drum 348 cooperates with cams (not shown) which move at least some of the filter tips axially so that the filter tips form a single row or column wherein the filter tips travel sideways toward a transfer point between the drum 348 and an intermediate drum 349. The latter is formed with circumferential grooves for entry of a portion of an accelerating drum 351 which accepts successive filer tips and accelerates the thus accepted filter tips to the speed of cigarette rod sections Z in the flutes of the assembly drum 339. The distance between the flutes of the accelerating drum 351 is the same as that between the flutes of the assembly drum 339. The drum 351 delivers filter tips into the spaces between axially aligned sections Z in successive flutes of the assembly drum 339.

The aforementioned assembly station 335 further accommodates a uniting drum 352 which accepts assemblies of sections Z and filter tips from the flutes of the assembly drum 339 and cooperates with the pasting unit 334 which includes a holder 353 for a real 353 of wrapping tape or web 335. The web 335 passes between and/or around deflecting rolls 356 and between a pair of advancing rolls 357, 358. The shaft of the advancing roll 357 can be driven by a gear of the filter cigarette machine and the advancing roll 358 is biased by springs (not shown) to urge the tape 355 against the periphery of the advancing roll 357. The roll 358 preferably of rubber or other elastomeric material. The paster 359 of the unit 334 comprises a tank 361 containing a supply of adhesive which is withdrawn by a withdrawing roller 362. The roller 362 delivers a film of paste to the periphery of a rotary applicator roller 363 which transfers paste to the underside of the web 355. A displacing roller 364 which is mounted on a pivotable lever 365 engages the web 355 upstream of the applicator 363. The lever 365 can be pivoted by an electromagnet 366 which permits the lever to move to the position shown in FIG. 6 when the filter cigarette machine is started whereby the web 355 can move to a lower level to engage the peripheral surface of the applicator 363. The electromagnet 366 is deenergized when the filter cigarette machine is arrested whereby the lever 365 causes the roller 364 to lift the web 355 above and away from the applicator 363.

A suction drum 367 of the unit 334 is mounted downstream of the applicator 363 and cooperates with a rotary knife 368 to subdivide the web 355 into a series of adhesive-coated uniting bands which are applied to the assemblies of filter tips and cigarette rod sections Z in successive flutes of the uniting drum 352. The drum 367 is preferably driven at a speed which exceeds the speed of the web 355 so that successively formed uniting bands are automatically separated by gaps of desired width in order to insure unimpeded transfer of each uniting band to the assembly in the adjoining flute of the drum 352. The drum 367 accommodates a stationary suction chamber and its cylindrical shell is formed with suction ports so that the leading end of the web 355 and the uniting bands are caused to adhere to the periphery of the drum 367 during travel toward the point where the uniting bands are attached to successive assemblies of filter tips and cigarette rod sections 2.

The wrapping or convoluting unit 336 comprises a wrapping drum 369 which transports successive assemblies (with uniting bands attached thereto) past a stationary rolling member 371 which causes the assemblies to turn about their axes and to thus convolute the uniting bands around the corresponding filter tips and the adjoining ends of associated sections Z. The wrapping drum 369 has a peripheral surface along which the assemblies roll during travel past the rolling member 371 and whereon the assemblies are held by suction. Th distance between the periphery of the drum 369 and the rolling member 371 is somewhat less than the diameter of a filter tip.

The receiving unit 337 comprises a testing drum 372 which tests filter cigarettes of double unit length for the integrity of their fillers and/or wrappers and causes ejection of defective filter cigarettes. Satisfactory filter cigarettes of double unit length are transferred into the flutes of a severing drum 373 which cooperates with a rotary disk-shaped knife 374. This knife severs each filter cigarette of double unit length midway between the axial ends of the respective filter tip so that each such cigarette yields two filter cigarettes of unit length. The two rows of thus obtained filter cigarettes of unit length are thereupon transferred onto an inverting drum 375 where the cigarettes of one row are inverted end for end so that their filter tips face in the same direction as the filter tips of cigarettes in the non-inverted row. The drum 375 also converts the two rows of filter cigarettes of unit length into a single row which is delivered onto the upper stretch of a endless take-off conveyor 376. The cigarettes are transported past a further testing unit 377 which examines the free ends of tobacco fillers in successive cigarettes and transmits signals to an ejector nozzle 378 which expels defective cigarettes. The remaining (satisfactory) cigarettes of unit length are thereupon transported to a packing machine, to a transfer device where the cigarettes are stacked in tras, or to another destination.

The means for rotating the various drums, cutters and other movable parts of the filter cigarette machine shown in FIG. 6 is of conventional design. The drums are preferably rotated by gears. The drive means includes a first clutch 379 which is mounted on the shaft of the accelerating drum 351 and a second clutch 381 on the shaft of the driven advancing roll 357.

Figure 7:
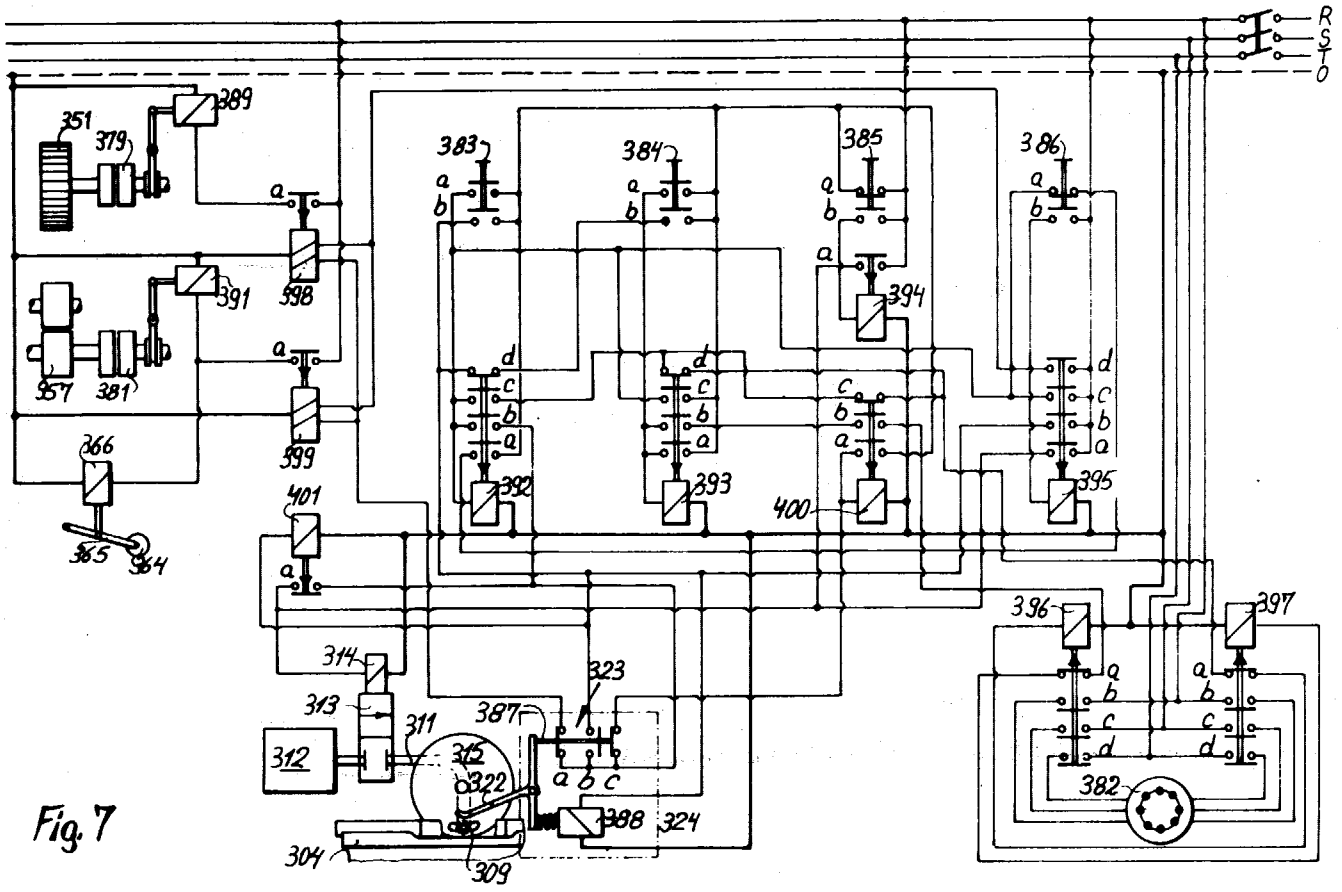
FIG. 7 is a diagram illustrating the electric circuit of the fourth apparatus.

The diagram of FIG. 7 illustrates the electric circuit of the apparatus which includes the machines of FIGS. 5 and 6. The diagram further shows certain mechanical parts of the two machines, such as the trough 304 of the cigarette rod machine, the arm 322 of the monitoring device 323, the regulating valve 313, its solenoid 314, the source 312 of compressed air, the timer disk 315, the ejector or removing nozzle 309, and the supply conduit 311. The illustrated parts of the filter cigarette machine include the accelerating drum 351 with clutch 379, the advancing roll 357 with clutch 381, the lever 365 with displacing roller 364, and the electromagnet 366.

The cigarette rod machine is driven by a variable-speed electric motor 382. The motor circuit comprises four switches including a first starter switch 383 which corresponds to switch 24, a second starter switch 384 corresponding to switch 26, an arresting switch 385, and a starter switch 386 for initiating coasting of the cigarette rod machine. Each of these switches has two movable contacts *a* and *b*. The contacts *a* of the switches 385, 386 are closed in the idle or non-depressed positions of these switches. All other contacts *a* and all contacts *b* are closed only in response to depression of the respective switches.

The monitoring device 323 can actuate a control switch 387 which is actuated in response to changes in position of the arm 322 and has three contacts *a*, *b* and *c*. The contacts *a* and *c* of the control switch 387 are closed when the arm 322 assumes its illustrated raised position. The arm 322 is operatively connected with the armature of an electromagnet 388. The arrangement is such that the armature holds the arm 322 in raised position when the electromagnet 388 is deenergized.

The drive means or clutches 379, 381 are engaged and disengaged by electromagnets 389, 391. The circuit further comprises six relays 392, 393, 394, 395, 396, 397 which can be energized without delay. The relay 394 has a single contact *a* and each of the relays 392–393, 395–397 has four contacts *a*, *b*, *c* and *d*. The contacts 392*d*, 393*d*,396*a* and 397*a* are closed in deenergized condition of the respective relays; the remaining contacts of these relays are open when the relays are deenergized. The contacts *b*, *c* and *d* of the relays 396, 397 are installed in the current-supplying circuit of the motor 382; the remaining contacts of these relays are installed in the control circuit. The control circuit further includes two time-delay relays 398, 399 which are energized as well as deenergized with a predetermined delay, a further relay 400 which is energized with a predetermined delay, and a relay 401 which is deenergized with a predetermined delay. Each of the relays 398, 399, 401 has a single contact *a* but the relay 400 has three contacts *a*, *b* and *c*. The contact 400*c* is closed in deenergized condition of the respective relay. The circuit further comprises four current supplying leads R, S, T, O; the lead O is the zero lead and is connected with relays 392–401 as well as with solenoid 314 and electromagnets 366, 388, 389 and 391. The lead R is conncted with the cotacts 385*a*, 385*b*, 394*a*, 386*b*, 395*a*–395*d*, 398*a* and 399*a*. When the arresting switch 385 is not depressed, the contact 385*a* supplies current to contacts 400*a*, 384*a*, 384*b*, 393*a*, 393*c*, 383*a*, 383*b* and 392*a*.

The cigarette rod machine of FIG. 5 is started by depressing the starter switch 383 of FIG. 7. The contact 383*a* energizes the relay 392 and the contact 383*b* energizes the electromagnet 388 which releases the arm 322 of the monitoring device 323. The contact 383*b* further energizes the relay 401 so that the later closes its contact 401*a*. The contact 392*a* completes the holding circuit of the relay 392 by way of closed contact 386*a*. At the same time, current begins to flow through closed contacts 392*b* and 392*c* of the relay 392. The contact 392*a* supplies current to stationary contacts of the control switch 387 and the closed contact 401*a* energizes the solenoid 314 to effect opening of the regulating valve 313. The contact 387*b* is closed in response to downward movement of the arm 322 so that the circuit of relay 401 is completed by way of contact 387*b* and the electromagnet 388 is energized. The starter switch 383 is then released to return its contacts to the illustrated positions; however, this does not affect the remaining parts of the circuit. The contacts 400*c* and 393*d* are connected in parallel. One of these contacts cooperates with the closed contact 393*d* to energize the relay 396 by way of contact 397*a*. The contacts *b–d* of relay 396 then connect the energy source (leads R, S, T, O) with that winding of the motor 382 which causes the latter to rotate at a lower speed.

When the arm 322 is lifted, it opens the contact 387*b* to open the circuit of the electromagnet 388 whereby the latter maintains the arm 322 in raised position. Such raising of the arm 322 also opens the circuit of the relay 401 which is deenergized with a predetermined delay and deenergizes the solenoid 314 to close the regulating valve 313. The circuits of relays 98, 399 are completed by way of contact 387*a* so that these relays energize the electromagnets 389, 391 and 366 with a predetermined delay. The electromagnets 389, 391 energize the drive clutches 379, 381 and the electromagnet 366 lowers the displacing roller 364. The circuit of the relay 400 is completed by way of the contact 387*c* so that the contact 400*c* opens with a predetermined delay but without any immediate effect because the contact 393*d* (which is connected in parallel with the contact 400*c*) remains closed. Contact 400*b* closes simultaneously with opening of the contact 400*c* and the holding circuit of the relay 400 remains completed by way of contact 400*a*. After elapse of all delays, the clutches 379, 381 are engaged, the displacing roller 364 is in ineffective (lowered) position, the regulating valve 313 is closed, the arm 322 is in raised position, and the motor 382 is rotated at the lower speed. The arm 322 is held in raised position by cigarette rod sections Z which are being severed from the wrapped cigarette rod 310.

If the operator thereupon depresses the second starter switch 384, the contacts 384*a*, 384*b* are closed and the contact 394*a* energizes the relay 393. If the contact 392*d* is closed, the closed contact 384*b* energizes the electromagnet 388 and relay 401. This takes place only when the second starter switch 384 is depressed ahead of the first starter switch 383, i.e., while the cigarette rod machine is idle. If the depression of starter switch 383 precedes depression of the starter switch 384, the contact 392*d* is open so that the contact 384*b* cannot energize the electromagnet 383 and relay 401. The holding circuit of the relay 393 is completed by way of the contact 393*a*. The contact 393*c* completes the circuit of the relay 392 whereby the aforedescribed steps are repeated in the event that the relay 392 was not energized on depression of the first starter switch 383. If the relay 392 is energized and the delays determined by various relays have expired, the contact 396*a* receives current by way of contacts 393*b* and 400*b*. The contact 393*d* opens the circuit of the relay 396 but this relay is deenergized only after the relay 400 opens its contact 400*c*. Deenergization of the relay 396 results in closing of the contact 396*a* and in energization of relay 397 so that the contact 397*a* opens to open the circuit of the relay 396. At the same time, the contacts *b*, *c* and *d* of the relay 397 connect the high-speed winding of the motor 382 with the energy source. It will be seen that the motor 382 can operate at higher or normal speed only in response to depression of the second starter switch 384 and on energization of the relay 400. Since the relay 400 is energized only when the arm 322 closes the contact 387*c*, the cigarette rod machine can be operated at normal speed only if the arm 322 detects the presence of cigarette rod sections Z. The time-delay relays 398, 399 and 400 further insure that the cigarette rod machine can operate at normal speed only when the clutches 379, 381 are engaged. Furthermore, the second starter switch 384 can initiate acceleration of the cigarette rod machine to normal speed only after depression of the first starter switch 383. The cigarette rod machine is started at the lower speed even if the starter switch 384 is depressed ahead of the starter switch 383.

If the operator decides to depress the arresting switch 385, the contact 385*a* opens the circuit of the relays 392 and 393 so that these relays are deenergized without delay. This results in deenergization of all solenoids, electromagnets and relays; the clutches 379, 381 are disengaged with a delay, the electromagnet 366 is also deenergized with a delay to lift the lever 365 and roller 364 so that the web 355 is moved away from the applicator 363 of the paster 359, and the motor 382 is arrested. The contact 385*b* causes energization of the relay 394 which closes the contact 394*a* and energizes the solenoid 314 to open the regulating valve 313, i.e., all cigarette rod sections Z which are produced during deceleration of the cigarette rod machine are automatically ejected by nozzle 309. The ejection continues as long as the arresting switch 385 remains in depressed position.

If the operator decides to depress the starter switch 386 to initiate coasting of the motor 382, the contact 386*a* opens the holding circuit of the relay 392 and the contact 386*b* causes energization of the relay 395. The contact 385*a* energizes the solenoid 314 to open the regulating valve 313. The contact 386*b* energizes the electromagnet 388 which releases the arm 322. The contact 395*c* energizes the relay 392 which causes energization of the relay 396 by way of contacts 392*c*, 400*c* and 397*a* so that the motor 382 begins to rotate at the lower sped. The contact 395*d* energizes the relays 398, 399 each of which has two connections and each of which is energized without delay by way of the contact 395*d*. The clutches 379, 381 are engaged and the electromagnet is energized to lower the level 365 and displacing roller 364. Such condition prevails as long as the switch 386 remains depressed. When the switch 386 is released, the motor 382 is arrested.

The operation of the apparatus including the cigarette rod machine of FIG. 5 and the filter cigarette machine of FIG. 6 is as follows.

The wrapped cigarette rod 310 is formed in the same way as described in connection with FIG. 1, i.e., a tape of cigarette paper is converted into a tubular wrapper which surrounds a travelling filler rod and is provided with a film of adhesive along one of its edges. The rod 310 advances toward the cutoff 305 and is severed by the orbiting knife 306 to yield a succession of cigarette rod sections Z each of which constitutes a plain cigarette of unit length. Each preceding section Z is pushed lengthwise of the trough 304 by the next-following section and each section which reaches the accelerating device 325 is propelled by the lobe 326 to enter the adjoining flute 329 of the transfer drum 328. Such section comes to rest when it reaches the corresponding stop 331. The sections Z in the flutes 329 form two rows of columns which travel sideways toward the transfer point between the drum 328 and the aligning drums 338. The arm 322 is located at a level about the path of sections Z in the trough 304 and is lifted by the sections. Of course, each section Z which travels along the timer disk 315 is ejected from the trough 304 as long as the regulating valve 313 remains connected with the source 312 of compressed air. Rotation of the disk 315 is timed in such a way that the slot 321 permits passage of compressed air from the orifice of the nozzle 309 only when the center of gravity of a cigarette rod section Z in the trough 304 is in registry with the nozzle. The valve 313 is open until the arm 322 is lifted by the foremost section Z. The delay which is produced by the relay 401 insures that the foremost section or sections Z are ejected from the trough 304 before the valve 313 closes. Thus, the sections Z which are obtained on severing of the leading end of a freshly formed wrapped cigarette rod 310 are automatically ejected before they can reach the flutes 329 of the transfer drum 328. The length of the interval during which the freshly severed sections Z are ejected irrespective of their condition can be determined in advance and can be varied within a desired range to insure that all potentially defective sections which are obtained when the cigarette rod machine is started to resume operation are invariably ejected from the trough 304 and cannot enter the filter cigarette machine.

The sections Z in the flutes 329 of the transfer drum 328 travel toward the aligning drums 338 of FIG. 6 and the sections travelling with one of the drums 338 are moved faster or through greater distances than the sections in the other drum 338 so that the drums 338 place each section Z in one of these drums into exact axial alignment with a section in the other drum 338 not later than at the time when the thus aligned pairs of sections Z enter the flutes of the assembly drum 339. The magazine 341 discharges filter rods of sextuple unit length into successive flutes of the cutting drum 342 which moves the rods past the cutters 343, 344 whereby each rod yields three filter tips of double unit length. The staggering drums 345–347 thereupon shift the filter tips sideways so that each filter tip is out of axial alignment with the adjoining filter tips, and the filter tips are then moved axially to form a single row or column which moves sideways in the flutes of the aligning drum 348. Successive filter tips of the column are transferred into successive flutes of the intermediate drum 349 which delivers such filter tips to the accelerating drum 351. The latter accelerates the filter tips and deposits them into the spaces between pairs of axially aligned sections Z in the flutes of the assembly drum 339. Transfer of filter tips from the intermediate drum 349 into the flutes of the assembly drum 339 takes place only when the cluch 379 is engaged. The engagement of clutch 379 takes place with a delay which is determined by the relay 398 and which is long enough to insure that a section Z can move from the arm 322 to the assembly drum 339 before the clutch 379 is engaged while the motor 382 is driven at the lower speed. Since the circuit of the relay 398 can be completed only when the arm 322 detects the presence of sections Z in the trough 304, the feeding unit 333 of FIG. 6 can supply filter tips to the flutes of the assembly drum 339 only when such flutes accommodate pairs of axially aligned cigarette rod sections Z.

The resulting assemblies (each of which includes two sections Z and a filter tip therebetween) are thereupon transferred into the flutes of the uniting drum 352 and at least one section Z of each assembly is moved axially toward the other section Z to insure that the inner ends of the sections abut against the adjoining ends of the corresponding filter tip.

The reel 354 pays out the web 355 which is advanced by the rolls 357, 358 and is coated with adhesive during travel past the applicator 363 of the paster 359. The thus coated web 355 is severed by the knife 368 to yield a succession of uniting bands each of which is applied to the filter tip in the adjoining flute of the uniting drum 352 in such a way that portions of the uniting band extend beyond the ends of the respective filter tip. The driven advancing roll 357 is connected with the prime mover of the filter cigarette machine only only when the clutch 381 is engaged. Engagement of this clutch takes place with a delay which is determined by the relay 399. Furthermore, the web 355 can reach the periphery of the applicator 363 only when the electromagnet 366 permits the lever 365 and roller 364 to assume the positions shown in FIG. 6. The electromagnet 368 is also energized with a delay which is determined by the relay 399. Such delay corresponds to the interval of time required to transport a cigarette rod section Z from the arm 322 to the uniting drum 352 while the motor 382 is operated at the lower speed. Such delay insures that the filter cigarette machine supplies properly coated uniting bands only when that flute of the uniting drum 352 which is adjacent to the suction drum 367 accommodates an assembly including two cigarette rod sections Z and a filter tip of double unit length.

The assemblies which carry uniting bands are thereupon transferred into the flutes of the wrapping drum 369 and travel past the stationary rolling member 371 which cooperates with the drum 369 to convert successive uniting bands into tubes each of which surrounds the respective filter tip and the adjoining ends of the respective sections Z, i.e., the drum 369 then carries a series of filter cigarettes of double unit length which advance sideways toward the transfer point between the drum 369 and testing drum 372. The latter is preferably provided with pneumatically operated testing means which examines the filter cigarettes of double unit length for the integrity of their wrappers. Such examination normally involves determination of eventual leaks in the wrappers of sections Z, in the wrappers formed by uniting bands supplied by the suction drum 367, and in the regions where the wrappers or tubes formed by convoluted uniting bands surround the wrappers of the respective sections Z. Each satisfactory filter cigarette of double unit length is permitted to advance beyond the testing drum 372 and to enter one flute of the severing drum 373 which cooperates with the knife 374 to sever each such cigarette to form pairs of filter cigarettes of unit length. One row of filter cigarettes of unit length is transferred by the inverting drum 375 onto the upper stretch of the take-off conveyor 376. The cigarettes of the other row are inverted end for end and are placed between the cigarettes of the one row so that the upper stretch of the conveyor 376 receives a single row of filter cigarettes of unit length wherein the filter tips face in the same direction. The arrangement is preferably such that each cigarette which is to be inverted completes a little more than one revolution about the axis of the inverting drum 375 whereas the non-inverted cigarettes merely cover the short distance from the transfer point between the drums 373, 375 to the transfer point between the drum 375 and conveyor 376.

The density of the free end of the cigarette rod section Z in each filter cigarette on the upper stretch of the conveyor 376 is tested (for example, with mechanical testing means) by the drum 377 which sends signals to the ejector nozzle 378 whenever it detects a defective filter cigarette so that such cigarette is ejected from the conveyor 376, for example, by being propelled axially at right angles to the plane of FIG. 6.

The main purpose of the monitoring device 323 is to insure that the length of intervals during which the operating condition of the cigarette rod machine differs from the normal operating condition during acceleration of the cigarette rod machine is reduced to a period of time which is required for the production of one or a few filter cigarettes. In the cigarette rod machine of the apparatus shown in FIGS. 1–2, 3 or 4, all of the articles produced during operation of the machine at lower speed are ejected. In the apparatus of FIGS. 5 and 6, the operating conditions at the station accommodating the cigarette rod machine can be normal even when the motor 382 is driven at the lower speed. This is due to the fact that the filter cigarette machine of FIG. 6 can produce satisfactory filter cigarettes at the lower of several operating speeds.

The monitoring device 323 monitors the path in which the sections Z travel from the cigarette rod machine toward the filter cigarette machine to detect the presence of sections Z which are produced at the station accommodating the cigarette rod machine upon resumption of interrupted production of sections. The arm 322 of the monitoring device 323 can terminate removal or ejection of sections Z upon detection of the first section Z of another predetermined section Z which is produced upon resumption of operation of the cigarette rod machine. In this way, the nozzle 309 segregates only one section Z or only a few of those sections Z which are produced while the cigarette rod machine operates below its normal speed.

Furthermore, and as fully described above, detection of sections Z in the path between the cigarette rod machine of FIG. 5 and filter cigarette machine of FIG. 6 can be used for additional purposes, namely, to actuate the drive means 379, 381 of the filter cigarette machine at the exact moment when the foremost satisfactory section or sections Z assume a predetermined position at the station which accommodates the filter cigarette machine. This insures that the delivery of filter tips and the application of adhesive-coated uniting bands does not begin before the filter cigarette machine begins to receive pairs of cigarette rod sections Z in optimum positions for carrying out the conversion of such sections and filter tips into filter cigarettes of double unit length. Furthermore, such mode of operation insures that the delivery of filter tips to the flutes of the assembly drum 339 and the delivery of uniting bands to be uniting drum 352 begins with a predetermined delay following detection of sections Z by the monitoring device 323.

The apparatus of FIGS. 5 and 6 reduces the number of sections Z which are ejected or segregated from remaining sections subsequent to starting of the cigarette rod machine. This is due to the provision of the arm 322 which detects the presence of freshly produced sections Z (i.e., of those sections which are produced subsequent to resumption of operation of the cigarette rod machine) and terminates the ejection of sections upon detection of the foremost freshly produced section Z or upon detection of another predetermined section Z in the column of sections which are produced upon resumption of operation. Of course, the arm 322 is provided only when the cigarette rod machine of FIG. 5 is capable of producing satisfactory sections Z as soon as it resumes operation after a shorter- or longer-lasting interruption of production. However, even under such circumstances, the arm 322 preferably permits ejection or segregation at one or more freshly produced sections Z to make sure that the filter cigarette machine of FIG. 6 receives only such sections Z which are satisfactory and can be combined with filter tips to form high-quality filter cigarettes.

What is claimed as new and desired to be protected by Letters Patent is set forth in the appended claims.

1. A method of classifying cigarettes or analogous rod-shaped articles, comprising the steps of producing rod-shaped articles under different operating conditions at least one of which is at least conductive to the production of defective articles, including forming a continuous wrapped filler rod in a rod making machine, moving the rod axially, and subdividing the rod into sections of equal length at a first station whereby such sections constitute a series of discrete rod-shaped articles; transporting the articles of said series lengthwise along a predetermined path toward a second station; moving successive articles which reach said second station away from said second station; and removing from said path those articles which are produced while said one condition prevails, including subjecting each article to be removed to the expelling action of a gaseous fluid only when such article reaches a predetermined portion of said path, said expelling action of said gaseous fluid including moving the articles to be removed sideways from said predetermined portion of said path.

2. A method as defined in claim 1, wherein said step of moving articles from said second station comprises advancing the articles sideways.

3. A method as defined in claim 1, wherein said removing step includes subjecting each article to be removed to the action of a stream of compressed gaseous fluid.

4. A method as defined in claim 1, further comprising the step of starting said removing step when an article to be removed is located at a predetermined distance from said first station.

5. A method as defined in claim 1, wherein said removing step includes subjecting each article to be removed to the expelling action of a stream of compressed gaseous fluid, and further comprising the step of synchronizing the action of each fluid stream upon the respective article in said predetermined portion of said path with the rate of transport of articles to be removed along said path.

6. A method as defined in claim 1, wherein said one condition prevails immediately following the starting of said machine and said removing step includes expelling from said path each article, if any, which is located upstream of said predetermined portion of said path prior to starting and at least one article which is produced subsequent to starting of said machine, the removal taking place in said predetermined portion of said path subsequent to renewed starting of the machine.

7. A method as defined in claim 6, further comprising the step of monitoring said path following the starting of said machine to detect the presence of articles which are produced subsequent to starting, and terminating said expelling step upon detection and expulsion of a predetermined number of articles which are produced subsequent to starting, said predetermined number exceeding one.

8. In an apparatus for the production and classification of cigarettes or analogous rod-shaped articles under different operating conditions at least one of which is at least conducive to the production of defective articles, a combination comprising a machine having means for forming a continuous wrapped filler rod, means for moving said rod axially, means for subdividing said rod into sections of equal length at a first station whereby such sections constitute a series of discrete rod-shaped articles, means for transporting the articles of said series lengthwise along a predetermined path toward a second station, and means for moving articles which reach said second station away from said second station; and means for removing from said path those articles which are produced while said one condition prevails, including means for subjecting each article to be removed to the expelling action of a gaseous fluid when such article reaches a predetermined portion of said path, said expelling action of said gaseous fluid including moving the articles to be removed sideways from said predetermined portion of said path.

9. A combination as defined in claim 8, further comprising first signal generating means operable to establish said one condition, second signal generating means operable to terminate said one condition, timer means for initiating the removal of articles which are produced during the interval between establishment and termination of said one condition, and means for synchronizing the operation of said timer means with the operation of said severing means.

10. A combination as defined in claim 9, further comprising means for respectively activating and deactivating said timer means in response to operation of said first and second signal generating means.

11. A combination as defined in claim 9, wherein said means for subjecting the articles to be removed to the expelling action of a gaseous fluid comprises a source of compressed air, conduit means for conveying streams of compressed air from said source to said portion of said path, normally closed valve means in said conduit means, and means for opening said valve means at a frequency determined by said timer means while said timer means is activated in response to operation of said first signal generating means.

* * * * *